United States Patent [19]

Bouyoucos et al.

[11] 4,166,507

[45] Sep. 4, 1979

[54] PERCUSSIVE DRILLING APPARATUS

[75] Inventors: John V. Bouyoucos, Rochester; Robert F. DeLaCroix, Penfield, both of N.Y.

[73] Assignee: Hydroacoustics, Inc., Rochester, N.Y.

[21] Appl. No.: 883,565

[22] Filed: Mar. 6, 1978

[51] Int. Cl.[2] ..... B25D 9/00

[52] U.S. Cl. ..... 173/105; 173/116; 173/118; 173/131; 173/139

[58] Field of Search ..... 173/14, 105, 106, 107, 173/116, 118, 131, DIG. 4, 139

[56] References Cited

U.S. PATENT DOCUMENTS

| | | | |
|---|---|---|---|
| 1,857,624 | 5/1932 | Degenhardt et al. | 173/116 X |
| 2,260,268 | 10/1941 | Warren et al. | 173/116 |
| 2,373,972 | 4/1945 | Moreno | 173/116 X |
| 2,388,877 | 11/1945 | Souter | 173/116 X |
| 3,250,335 | 5/1966 | Joelson | 173/116 X |
| 3,547,208 | 12/1970 | Swain et al. | 173/105 X |
| 3,570,609 | 3/1971 | Wise | 173/131 X |
| 3,596,562 | 8/1971 | Foster et al. | 173/DIG. 4 |

FOREIGN PATENT DOCUMENTS

| | | | |
|---|---|---|---|
| 467165 | 10/1975 | U.S.S.R. | 173/116 |

*Primary Examiner*—Lawrence J. Staab
*Attorney, Agent, or Firm*—Martin LuKacher

[57] ABSTRACT

A hydraulic rotary percussive drill which is adapted to operate as a drill for installing rock bolts in mines is described. The drill is configured so that the shank (which holds the drill steel and bit) forms a right angle with the impact mechanism, thereby reducing the height of the drill and providing longer lengths of drill steel feed in a confined environment. A hydraulic spring force coupler transfers the impact energy from the impact mechanism to the shank, steel and bit and shapes the energy so as to provide force pulses of such length as to couple efficiently the percussive energy to the rock being drilled while reducing the strain in the steel and bit. A rotation mechanism may be mounted in the same leg of the right angle as the shank, steel and bit to rotate the steel and bit independently from the percussive action.

9 Claims, 1 Drawing Figure

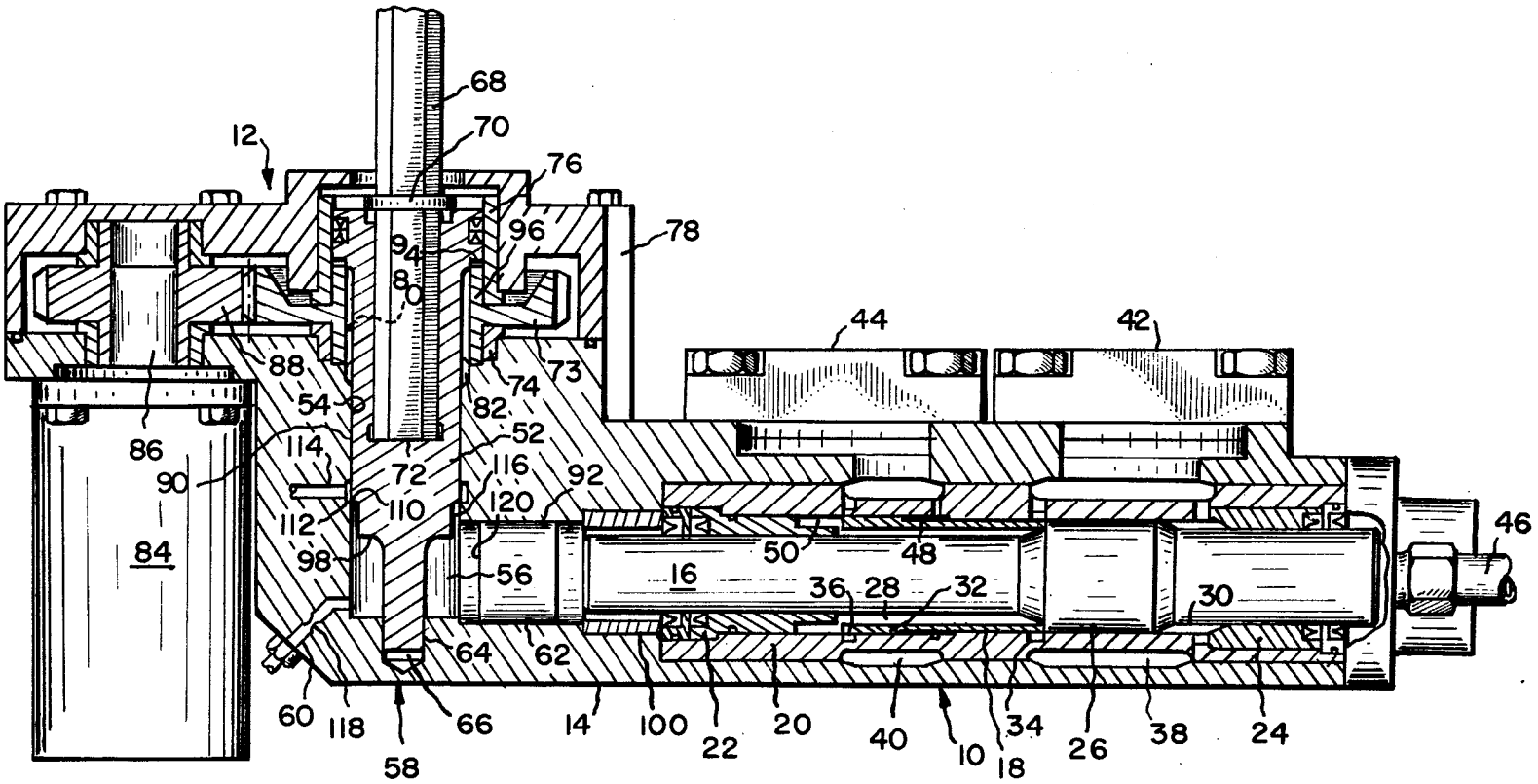
46
24
30
38
42
26
34
18
10
32
48
28
40
44
36
50
20
22
16
100
78
14
92
62
73
76
96
74
52
116
120
56
68
70
82
64
66
72
110
58
94
80
118
54
114
112
98
60
88
12
90
86
84

PERCUSSIVE DRILLING APPARATUS

The present invention relates to percussive drilling apparatus and particularly to a rotary percussive drill which is adapted for drilling holes for installation of rock bolts in underground mines.

While the invention is especially suitable for use as a drill for installing rock bolts in mines, it also has application wherever drilling in confined spaces is required.

Installation of rock bolts is usually performed with the aid of rotary drills. Such rotary drills do not operate well when hard rock is encountered. When the rock formation has inclusions or layers of hard rock, such as abrasive quartzite, limestone or slate, the penetration rate is reduced and the drill bits are quickly dulled. Percussive drills have been of limited use for rock bolting because they generally do not match well to soft and medium soft rock and are too large for use in confined spaces as encountered in low seam mines. Conventional percussive drills also tend to shake the rock formation excessively.

It is desirable to be able to use rotary and percussive drilling in combination, especially when a variety of rock conditions are to be encountered. The percussive action causes the rock to fail in shear, thereby reducing the thrust and torque requirements of rotary drilling. The life of the drill bits is thereby increased over that obtained with rotary drilling alone which suffers due to the strength and abrasiveness of the rock. The combination of rotary and percussive drilling in one device which is suitable for use in confined spaces and particularly for rock bolt installation was not, prior to this invention, satisfactorily obtained. The problem in successfully combining percussive and rotary drilling in a single rock bolt installation or confined area drill has, in accordance with the invention, been determined to reside principally in the incompatibility of percussive and rotary drilling in the softer rock types, and in the conventional configuration of rotary-percussive drills where the rotation mechanism is in line with the impact mechanism, thereby leading to excessive drill length.

Matching of percussive drills to the loads presented by different formations may be accomplished with the aid of an impact spring, and both mechanical and hydraulic springs for such purpose are described in U.S. Pat. Nos. 3,382,932 issued May 14, 1968 and 3,570,609 issued Mar. 16, 1971. The use of hydraulic mechanisms for changing the direction of forces has also been noted (see U.S. Pat. Nos. 2,951,345 issued Sept. 6, 1960 and 3,516,052 issued June 2, 1970). Prior to this invention, such mechanisms have not been combined, nor utilized to solve the problems of rotary percussive drilling for rock bolt installation and operation in confined spaces. In accordance with the invention, both the function of matching the percussive forces to the formation and providing a configuration for operation in a confined space is obtained. The impact receiving member, such as the shank, drill steel and bit and its rotation mechanisms are placed at right angles to the impact mechanism by the use of a hydraulic spring coupler. By means of the hydraulic spring coupler the force pulses generated by the impact mechanism (viz., the hammer of the percussive drill) are shaped and matched to the softer rock formations. These pulses are coupled through the right angle to the impact receiving member which may be held against the roof of the mine or otherwise used in a confined space.

Accordingly, it is an object of this invention to provide an improved underground mining tool.

It is another object of the invention to provide an improved percussive drill suitable for use in confined spaces as in underground mines.

It is a further object of the invention to provide improved rotary percussion drilling apparatus which is especially adapted for rock bolting and otherwise for use in confined spaces such as low seam mines.

It is a still further object of the invention to provide an improved rotary percussive drill which is matched to rock formations of various types as may be frequently encountered in mines, such as both soft and hard rock formations.

Briefly described, percussive drilling apparatus embodying the invention is adapted for delivering impact energy to an impact receiving member, such as a shank which holds a drill steel and bit which then delivers the impact energy to the rock formation. The apparatus utilizes an oscillator which may be a hydroacoustic oscillator. The oscillator has a hammer which reciprocates along a first axis. The shank is mounted to reciprocate along an axis forming a right angle with the first axis. A hydraulic spring force coupler transfers the impact energy from the hammer to the impact receiving member. The hydraulic spring in the coupler matches the percussive forces to the load compliance so as to adapt these percussive forces for drilling soft and medium hard rock, as well as hard rock. The load consists of the shank, the drill steel, bit, and rock formation. The force coupler enables the impact receiving member which also may be rotated by a rotation mechanism, to be oriented along one leg of the right angle while the oscillator and its associated impact mechanism is oriented along the other leg of the right angle. Accordingly, the apparatus is of a size and configuration well adapted for use in rock bolting and otherwise in confined areas.

The foregoing and other objects, features and advantages of the invention and the presently preferred embodiment thereof will be more apparent from a reading of the following description in connection with the accompanying drawing which is a sole FIGURE showing a sectional view of a hydraulic rotary percussive drill embodying the invention.

Referring to the drawing, the illustrated drilling apparatus has an impact mechanism 10 and a rotation mechanism 12 mounted in the same housing 14. The impact mechanism 10 is provided by a hydroacoustic oscillator of the type described in U.S. Pat. No. 4,005,637 issued Feb. 1, 1977. The oscillator has a hammer 16 which is reciprocally movable along an axis oriented horizontally in the drawing. The hammer oscillates in a bore 18 defined by liners 20, 22 and 24. The liners 22 and 24 define end bearings for the hammer. The hammer 16 also has a central section 26 which defines an active cavity 28 and a passive cavity 30 on opposite sides thereof. A valve 32, in the form of a cylinder, is disposed in the active cavity 28 and slides along the wall of bore 18, opening and closing peripheral grooves 34 and 36 which serve as supply and return ports. These ports are connected to supply and return galleries 38 and 40. The supply gallery is also connected to the passive cavity 30. Supply and return accumulators 42 and 44 are connected to the galleries 38 and 40. The pressurized hydraulic fluid, such as hydraulic oil, is supplied to the drill by way of supply and return lines (one of which, 46, is shown) from a hydraulic power supply.

The valve 32 is mechanically actuated by engagement with the hammer section 26 and driven in one direction, to the left as shown in the drawing. The valve is actuated hydraulically to move in the opposite direction (to the right). A valve cavity 48 which is provided by a step in the valve and in the liner 20 receives hydraulic fluid at return pressure from the return gallery. Accordingly, when the active cavity is open to supply, which occurs when the valve is driven to the left and the supply port 34 is open, the hydraulic forces move the valve 32 to the right, back into position for engagement with the hammer on the next stroke. The pressure in the active cavity 28 is switched from supply to return pressure and the forces are applied to the opposite ends of the enlarged section 26 of the hammer 16 so as to drive the hammer into oscillation.

The frequency of oscillation may be controlled by controlling the flow of hydraulic fluid from a pocket 50, preferably back to the supply gallery 38, by means of a valve (not shown). The length of the stroke of the hammer can thereby be controlled so as to control both the frequency and blow energy delivered by the hammer. Such a control mechanism is described in patent application Ser. No. 666,733 filed Mar. 15, 1976 in the name of John V. Bouyoucos, now U.S. Pat. No. 4,077,304, issued Mar. 7, 1978.

The rotation mechanism 12 also includes the impact receiving member which has as a part thereof a shank 52 which is reciprocally movable along an axis perpendicular to the axis along which the hammer 16 is movable. The shank 52 is disposed in a bore 54. The axes of bore 54 and bore 18 intersect in a chamber 56. A hydraulic spring force coupler 58 for coupling the percussive forces and energy generated by the impact mechanism 10 to the shank 52 includes the chamber 56, which is filled with hydraulic fluid through a line 60, the shank 52 and an impact piston 62. The shank itself is rotatable in the bore 54 and is stabilized by means of a tail portion 64 thereof, which extends into a blind hole 66 in the housing 14.

The shank 52 also receives a drill steel 68, shown as having a hexagonal end. The steel 68 is connected to a drill bit and the bit may be brought against the rock formation for purposes of drilling holes as in the installation of rock bolts. A collar 70 on the steel and the lower end 72 thereof center the steel in the shank 52.

A gear 73 is mounted by flanged sleeves 74 and 76 in the housing 14 and in a cap 78, which is bolted to the housing 14. These sleeves 74 and 76 serve as bearings for the gear. The gear has splines 80 which are in engagement with splines 82 extending radially outward from the shank 52. A rotation motor 84, which may be a hydraulic motor, has a shaft 86 to which a gear 88 is attached. The gear 88 and the gear 72 mesh with each other so as to rotate the shank. Since the steel 68 is received in a hexagonal hole, in the shank 52, the steel and the bit rotate with the shank.

The lower portion of the shank may have an inward taper 90. The impact piston may also have an inward taper 92 on the left side thereof. The tapers form tapered bearings which permit the shank 52 and the impact piston 62 to slide freely in their bores.

The gear 73, while rotatable, is mounted in a fixed vertical position on housing 14. The shank 52 is formed with a step 94 which engages with the upper end of the hub 96 of the gear. The upper end 96 of the hub thus forms a thrust bearing for the shank.

During each cycle of oscillation, the hammer 16 strikes the impact piston 62 and transfers impact energy thereto. The impact energy is in the form of a percussive or force pulse which serves to compress the hydraulic fluid in the chamber 56. The force pulse is coupled through the fluid to the lower end 98 of the shank 52 which presents a surface to the fluid in the chamber 56 in a plane perpendicular to the axis along which the shank moves. The areas of the lower end 98 of the shank 52 and the face of the piston 62 may be different. The magnitudes of these areas and the volume of hydraulic fluid in the cavity 56 determine the effective stiffness of the fluid, and the load impedance presented by the shank drill steel, bit, and rock formation to the hammer. Through proper selection of these areas, the volume of the fluid cavity 56 and the mass of the hammer, the shape of the force pulse delivered to the load can be established that provides optimum drilling conditions,. For example, for soft and medium hard rock the force pulse can be shaped to provide a relatively large percussive bit deflection which reduces the thrust and torque otherwise required for rotary drilling, leading to an efficient combination of percussive and rotary action.

When the hammer 16 impacts repeatedly on the piston 62, the piston 62 will tend to migrate to the left in the figure unless the average pressure in the cavity 56 is sufficient to reseat the piston 62 against the shoulder of liner 100 after each blow. Such elevated pressure in cavity 56 occurs when the steel and bit are properly biased up against the formation to be drilled, and the surface area 98 of the shank is thrust into cavity 56. When the shank 52 is thrust into the cavity 56, a lip 110 on the shank tends to overlap a mating groove 112 in the housing 14. This groove 112 collects flow from cavity 56 and returns it to drain through line 114.

As mentioned above, cavity 56 is fed fluid from a high pressure source through line 60. The line 60 includes a restriction 118 which limits the maximum flow into cavity 56 and allows the pressure in cavity 56 to be low when the lip 110 on the shank uncovers groove 112 in the housing.

As downward force is applied on the shank by thrusting the steel and bit into the rock formation, lip 110 will tend to overlap groove 112 increasing the leakage resistance in the gap between the shank bearing and housing bore wall. As a result, the pressure in cavity 56 will rise until the pressure force on the shank area 98 equals the bias force of the bit against the formation. The bias force of the bit against the formation must be sufficient to reseat the bit against the formation after each blow and prior to the next blow. By proper choice of the area 120 of the front face of piston 62, the corresponding average pressure force on piston 62 can be made sufficient also to reseat piston 62 between blows.

The frequency and blow energy may be varied to accommodate different types of rocks and to efficiently utilize hydraulic power which is supplied to the drill. The configuration of the drill with the rotation mechanism in one leg of a right angle and the impact mechanism in the other leg, rather than in line, allows the drill to operate in confined spaces and makes the drill especially adapted for roof bolting.

The drill may be used in various rock classifications from soft to top hard rock. Soft rock, such as coal, sandstone, limestone and shale, has a compressive strength in thousands of pounds per square inch (Kpsi)

from 10 to 20. The stiffness per inch of bit wedge length for soft rock in thousands of pounds per inch may be from 50 to 90. For medium rock, such as hard limestone, granite, gneiss and marble, the compressive strength is from 20 to 35 Kpsi and the stiffness from 90 to 130 K lbs/in. Hard rock, such as quartzite, granodiorite, types of gneiss, marble and basalt has compressive strength from 30 to 50 Kpsi and stiffness from 130 to 200 K lbs/in. Top hard rock such as taconite has compressive strength of from 50 to 70 Kpsi and stiffness from 200 to 500 K lbs/in. In order to match such a wide variety of rock, the impact mechanism consisting of the oscillating hammer 16 with mass $M_H$ and the hydraulic force pulse coupler with a stiffness $K_s$ must be designed to efficiently couple the kinetic energy of the hammer to the load. The load consists of the shank 52, drill steel 68, the bit which has a characteristic impedance $R_L$ and the rock formation which has an effective stiffness $K_L$. The mass of the hammer and the stiffness of the hydraulic spring force coupler are selected so that parameter Q is in the range of 0.7 and 1.5, and parameter $N_L$ is in the range 0.45 and 1.8 depending on the rock type. Q and $N_L$ are defined by the following equations:

$$Q = \frac{R_L}{\sqrt{K_s M_H}} \quad N_L = \frac{K_s}{K_L}$$

For soft rock $N_L$ is desirably between 1.0 and 1.8. For medium rock, values of $N_L$ between 0.69 and 1.0 are suitable. For hard rock, values of $N_L$ between 0.45 and 0.69 are similarly suitable.

The design of the drilling apparatus so as to provide a hammer mass and spring stiffness in the preferred range for efficiently transferring energy to the formation may be better understood from the following example in which the use of a four wing 1⅜" drill bit and ⅞" hex drill rod is considered. The drill rod area is about 0.62 inches squared and provides a characteristic impedance $R_L$ of 90 pound seconds per inch. Selecting $Q^2$ to be 2 (Q=1.414) and the hammer mass to be 8.7 pounds, the stiffness of the hydraulic force pulse coupler $K_s$ is 180 K lbs/in. It should be observed that $N_L$ is in the desired range for soft, medium and hard rocks. The hydraulic spring force pulse coupler also shapes the force pulse to have a duration of approximately $$\pi\sqrt{\frac{M_H}{K_s}}$$

or approximately 1.1 milliseconds. In the example given above using a blow energy of 50 foot-pounds per blow, the peak force is $9.8\times10^3$ pounds, or $12\times10^3$ pounds if the blow energy is 75 foot-pounds per blow. The higher blow energy is more suitable for hard and medium hard rocks while the lower is more suitable for the softer (soft and medium soft rocks). The blow energy may be adjusted so as to obtain the drilling rates which are desirable. For example, if a blow energy of 75 foot-pounds is used in hard or medium hard rocks the drilling rates should be between 5 and 6 feet per minute. Roof bolting operations should then require 2 to 2½ minutes per bolt (1 to 1½ minutes for drilling and 1 minute for bolt installation). Accordingly efficient and cost effective, roof bolting operations are provided by means of drilling apparatus provided in accordance with the invention.

From the foregoing description it will be apparent that there has been provided improved percussive drilling apparatus in which both rotary and percussive drilling may be carried out simultaneously. While a hydraulic rotary percussive roof drill has been described, it will be appreciated that variations and modifications thereof within the scope of the invention will undoubtedly suggest themselves to those skilled in the art. Accordingly, the foregoing description should be taken as illustrative and not in any limiting sense.

What is claimed is:

1. A rotary percussive drill for delivering impacts to a rock formation which comprises a housing having a first section and a second section which are disposed generally perpendicular to each other, said first and second sections respectively having first and second intersecting bores which have their axes perpendicular to each other, a hammer reciprocally mounted in said first bore, a shank for receiving a drilling implement reciprocally mounted in said second bore, an impact piston also reciprocally mounted in said first bore adjacent one end of said hammer in impact receiving relationship therewith, said piston and said shank and the walls of said bores at the intersection thereof defining a chamber containing hydraulic fluid, said shank and said impact piston defining a hydraulic force coupling spring for transferring impact energy from said impact piston to said shank, said hydraulic fluid in said chamber having sufficient stiffness such that the Q of said spring is between 0.7 and 1.5, where $$Q = \frac{R_L}{\sqrt{K_S M_H}}$$

where $R_L$ is the characteristic impedance of the drilling implement and the shank, $K_S$ is the stiffness of said spring and $M_H$ is the hammer mass, and where $N_L$ is between 0.45 and 1.8, where $N_L$ is the ratio $K_S/K_L$, and $K_L$ is the effective stiffness presented to the spring by the formation through the drilling implement and the shank, rotation and drive means coupled to said shank and contained in said second section, and oscillator means including said hammer for reciprocating said hammer contained in said first section, said housing sections providing a configuration for said drill which adapt said drill for use in confined areas.

2. The drill as set forth in claim 1 wherein said rotation and drive means comprises a motor having a shaft, said motor being connected to said second section, and said shaft having an axis parallel to the axis of said second bore, and means including gears and splines for rotatably coupling said motor shaft and said shank.

3. The rotary percussive drill as set forth in claim 1 wherein said shank has an area in a plane perpendicular to the axis of said second bore which presents a surface to said hydraulic fluid in said chamber, and said impact piston also has an area in a plane perpendicular to the axis of said first bore which presents a surface to the hydraulic fluid in said chamber, said shank area and said impact piston areas being perpendicular to each other.

4. The rotary percussive drill as set forth in claim 3 wherein said shank has a reduced diameter tail portion which extends through said chamber, said housing having a blind hole for receiving one end of said tail portion, said shank having a shoulder at the opposite end of said tail portion, said shoulder defining said area which presents said surface to said hydraulic fluid in said chamber.

5. The rotary percussive drill as set forth in claim 3 further comprising thrust bearing means mounted in said second bore, said shank having a step facing away from said chamber, said step being engageable with said thrust bearing means when said shank moves toward said chamber.

6. The rotary percussive drill as set forth in claim 5 wherein said thrust bearing means is provided by one of said gears of said rotation and drive means, said one gear having an opening, said shank extending through said opening, bearings in said housing rotatably mounting said gear therein, the end of said gear which faces away from said chamber being engageable with said shank step to define said thrust bearing.

7. The rotary percussive drill as set forth in claim 1 further comprising means for controlling the flow of said hydraulic fluid with respect to said chamber in response to the bias of said drilling implement and shank towards the formation to seat said impact piston against said hammer after each impact.

8. The rotary percussive drill as set forth in claim 7 wherein said flow controlling means comprises means for supplying said hydraulic fluid under pressure to said chamber, and porting means including an opening for the outflow of fluid from said chamber, said opening being disposed in said second housing in said second bore and adjacent to said chamber, and a lip on said shank communicating with said chamber for closing off said opening when said shank is biased towards the formation.

9. The rotary percussive drill as set forth in claim 8 wherein said opening is a groove in the wall of said second bore.

* * * * *